US007571579B2

(12) United States Patent
Ruiz

(10) Patent No.: US 7,571,579 B2
(45) Date of Patent: Aug. 11, 2009

(54) STRUCTURAL ELEMENT FOR THE CONSTRUCTION OF BUILDINGS

(76) Inventor: Antonio Reyes Ruiz, P.O. Box 1399, Wildomar, CA (US) 92595-1399

( * ) Notice: Subject to any disclaimer, the term of this patent is extended or adjusted under 35 U.S.C. 154(b) by 355 days.

(21) Appl. No.: 10/583,325

(22) PCT Filed: Dec. 17, 2004

(86) PCT No.: PCT/US2004/042154

§ 371 (c)(1),
(2), (4) Date: Jun. 16, 2006

(87) PCT Pub. No.: WO2005/065194

PCT Pub. Date: Jul. 21, 2005

(65) Prior Publication Data

US 2007/0130876 A1 Jun. 14, 2007

(30) Foreign Application Priority Data

Dec. 19, 2003 (MX) ..... PA/A/2003/012072

(51) Int. Cl.

| | |
|---|---|
| ***E04F 13/04*** | (2006.01) |
| ***E04B 1/16*** | (2006.01) |
| ***E04B 1/18*** | (2006.01) |
| ***E04B 1/20*** | (2006.01) |
| ***E04B 5/04*** | (2006.01) |
| ***E04C 2/04*** | (2006.01) |

(52) U.S. Cl. ..... 52/600; 52/730.2; 52/342; 52/378; 52/414; 52/335; 52/603

(58) Field of Classification Search ..... 52/730.2, 52/342, 378, 414, 600, 335, 603
See application file for complete search history.

(56) References Cited

U.S. PATENT DOCUMENTS

| | | | | | |
|---|---|---|---|---|---|
| 555,084 | A * | 2/1896 | Fordyce | ..... | 52/363 |
| 4,885,884 | A * | 12/1989 | Schilger | ..... | 52/354 |
| 5,414,972 | A * | 5/1995 | Ruiz et al. | ..... | 52/600 |
| 6,151,858 | A | 11/2000 | Ruiz et al. | | |
| 6,837,013 | B2 * | 1/2005 | Foderberg et al. | ..... | 52/356 |

* cited by examiner

*Primary Examiner*—Brian E. Glessner
*Assistant Examiner*—Omar Hijaz
(74) *Attorney, Agent, or Firm*—Birch, Stewart, Kolasch & Birch LLP

(57) ABSTRACT

A structural element for the construction of any type of buildings, comprising a first "C"-shaped element with equidistant cavities at least on one of its faces and a second element in the shape of a continuous strip with equidistant angular folds, whereby once both structural elements are assembled to each other, the angular folds of the metallic strip are projected through the cavities of the "C"-shaped structural element.

12 Claims, 4 Drawing Sheets

STRUCTURAL ELEMENT FOR THE CONSTRUCTION OF BUILDINGS

BACKGROUND OF THE INVENTION

The present invention refers to a structural element for the construction of building, particularly, to structural members for the connection of panels that are used to construct walls, slabs, soffits and the like.

With the passing of the years, several methods for prefabrication of structural elements have been developed with the purpose of reducing the costs related to materials and workmanship. These methods constitute an easy and economic manner to construct buildings, without sacrificing the structural integrity of the constructions.

Some of these methods of construction refer to prefabricated panels, which have been integrated by concrete panels or another similar material, which work like pre-assembled elements to form walls, slabs, soffits and other structural elements. These prefabricated structural elements are reinforced with elements such as rods or electro-soldered mats manufactured from high-resistance steel.

A typical prefabricated panel has numerous rods shaped in parallel form and metallic elements in an opposite sense, conformed in a plane concrete panel. Said concrete panel usually has a thickness from 4 to 5 centimeters, although this thickness can vary depending on the particularities of the construction as well as the structural use for which it is going to be put into. To reinforce the load capacity, a reinforcement material can be added such as fibers of the polypropylene-type, steel fibers or a mixture thereof, frequently mixed with the concrete from which said elements are fabricated of. Metallic elements in the shape of a "C" are placed parallel to each other in which these prefabricated elements are placed.

The strength of these construction systems depends, to a great extent, on the integrity of the connection between the prefabricated panel and the structure itself of the construction. For instance, if the connection of the panel with the metallic structure of the construction is minimal, the panel strength will be also minimal, reason why it is necessary that connection is somehow secured as, for example, by means of the use of anchors that are adhered to the structural elements in such a manner that concrete can be strained thereon thereafter, this being so with the only purpose of fixing these panels in an appropriate manner and securing a good constructive joint.

Alternatively, other structural methods have arisen that are characterized by prefabricated metallic elements that consist of the core of the structural element for the manufacture of walls, slabs or soffits that, once attached to the structure through some available method such as soldering, riveting, or the like, are strained with concrete thus assuring that the connection of these panels with the metallic structure of the construction is obtained in an effective and reliable manner.

It is worth mentioning that there are patented structural systems in the market such as, for instance, the American invention with U.S. Pat. No. 5,414,972 which consists of a reinforced structural member for the connection of a construction panel such as a prefabricated panel employed for the manufacture of walls, slabs and soffits. This reinforced structural member is fastened to the metallic structural members of the construction with or by means of a plurality of anchors that fasten the construction panel. The reinforced structural member is specially adapted to be used with a composition of cementing elements such as concrete. This structural member substantially reinforces structurally the construction, while the anchors in this structural member assure a reliable connection between the construction structure and the panel that is to strained in concrete thereafter.

However, this invention presents some drawbacks such as the one resulting from the manner in which the structural element is fastened to the framework of the panel itself, as the connection from one to another must be effected by means of a wire or other similar system to proceed to the straining of the structural set thereafter.

Another similar invention is registered with the U.S. Pat. No. 6,151,858, dated Nov. 28, 2000, which consists of a construction system using the structural beams of the construction itself, both horizontally and vertically, from which "L"-shaped anchors protrude by means of gravity. This system like the previous has some drawbacks since the manufacturing of the structural elements is expensive and, in addition, the selected anchors of the structural element such as columns or beams, reduce the structural resistance of the structure itself.

However, both inventions assure in a "reliable" manner the connection between those panels manufactured to be used as walls, slabs or soffits, and the structure of the construction itself.

According to the previous, a variety of constructive systems have existed tending to assure that the structure of the construction itself with the other constructive elements such as walls, soffits and slabs have a reliable and safe connection that assures the resistance of these systems against the several physical forces involved in the constructions.

OBJECT OF THE INVENTION

The present invention has as its object to provide a more reliable structural system for the fastening of structural elements of the construction such as poles, cross-beams and columns or steel beams, with structural elements such as walls, slabs and soffits.

This invention consists of two independent elements. The first one is a "C"-type structural profile, made from steel, of which thickness can vary. The metallic element serves both as a pole and as a cross-beam as well as can be used as a column or beam which are to function in a structural manner in the building. This metallic profile has several cavities in quadrangular shape at both of its parallel edges.

A second element, also metallic, is a steel strip which has among its particularities triangular shaped folds, which match in dimension and length with the cavities of the first "C"-type metallic element.

The triangular folds in the metal strip have, in each of their faces, a circular perforation, fit with each other.

Once the metal strip is attached to any of the parallel edges of the first "C"-type metallic element, the triangular folds protrude from the quadrangular cavities of the "C"-type metallic element.

After the metal strip with the triangular folds is inserted into the "C"-type metallic element, a steel element, preferably a steel rod, is passed through the circular perforation of the two faces of the triangular folds of the metal strip, with the purpose of achieving a reliable seam between those metallic elements of the present invention that can bring about the function of poles or cross-beams, as well as columns and beams, and the frames of the panels which will strained thereafter, in situ, with cement materials such as concrete.

Thus, the frames of the panels that can function as walls, slabs or soffits and the metallic elements that are the object of this invention achieve a reliable seam, since the frames of the soffits, walls or slabs that can be made both of steel rods and of electrosoldered mat made of high-resistance steel, are entwined to the structure of the construction by means of the circular perforations of the triangular folds of the metallic strip of the present invention. In a subsequent step, the panels are strained with a cement material such as concrete, thus assuring the perfect structural seam between the elements that are the object of this inventions and the panels manufactured in situ, that can be walls, soffits or slabs.

DETAILED DESCRIPTION OF THE INVENTION

Figure 1:
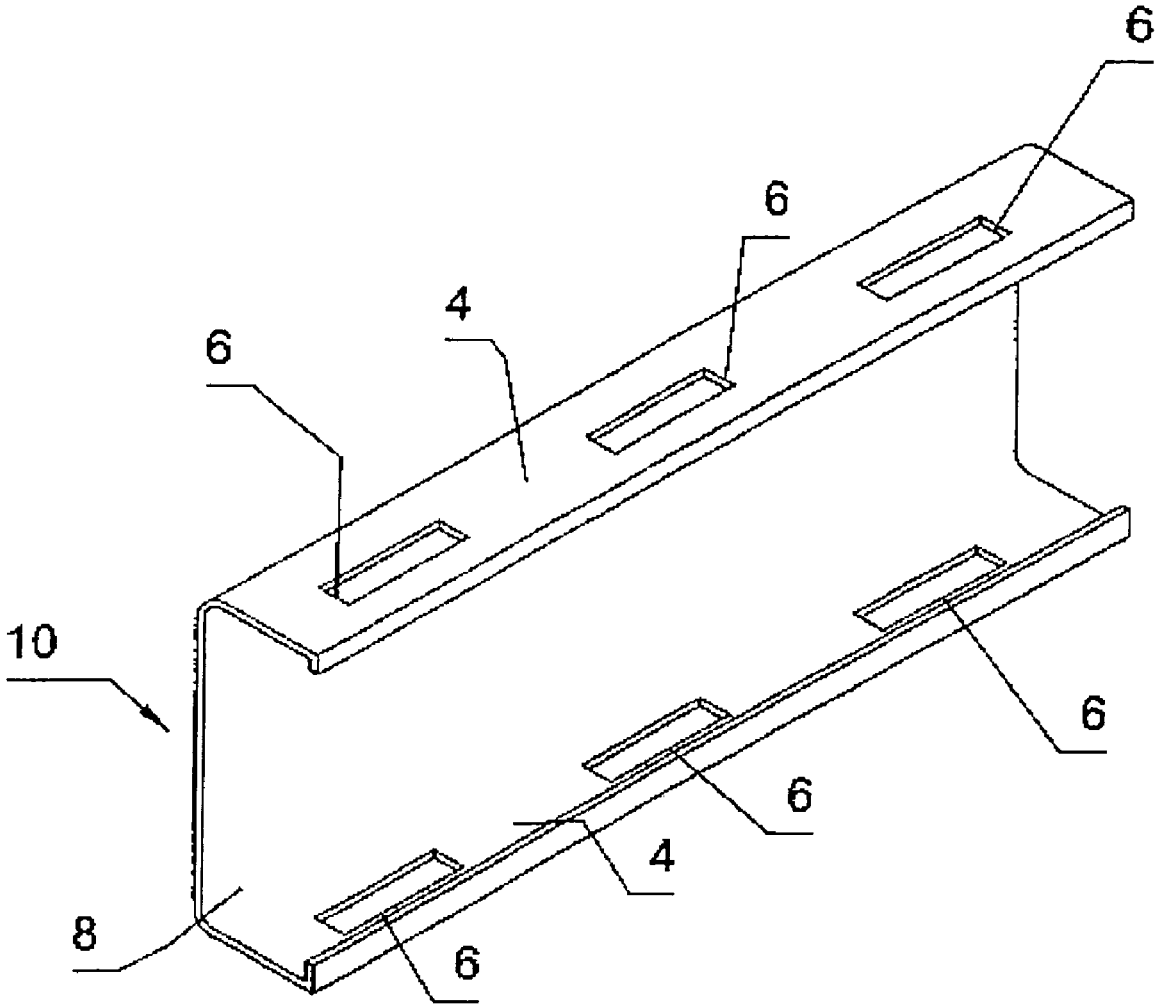
FIG. 1 is an isometric view of the "C"-type metallic element, showing a series of rectangular cavities in its the parallel edges.
Figure 2:
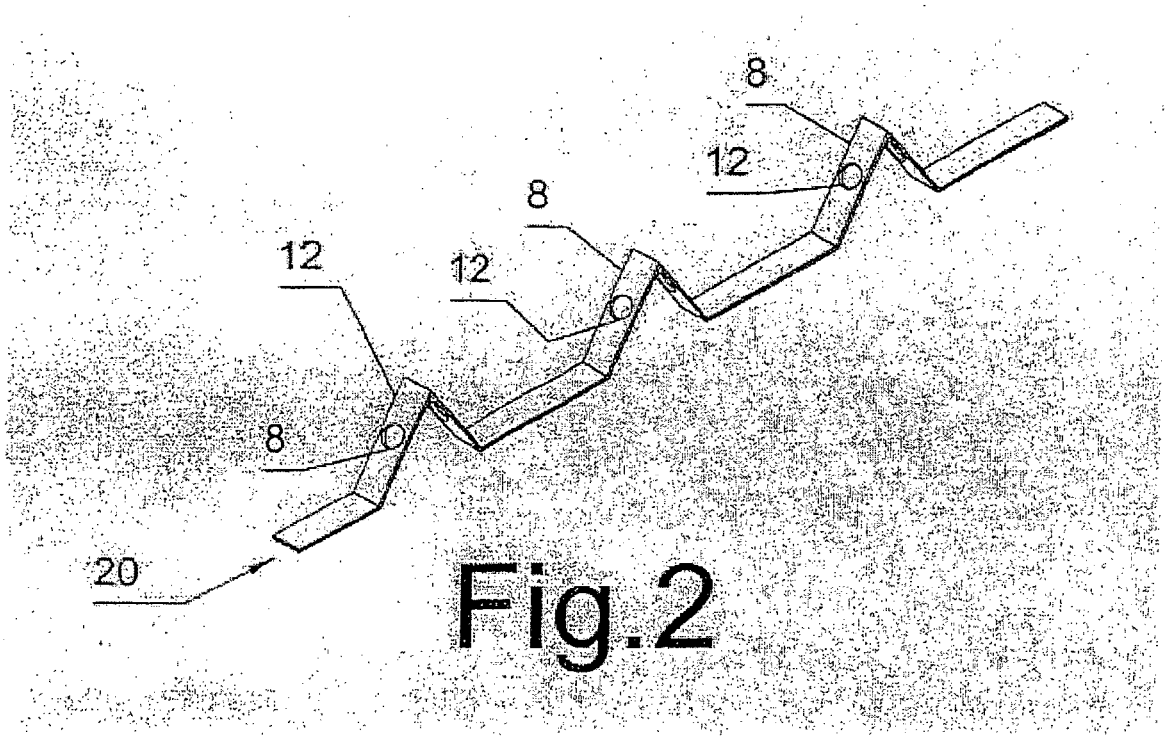
FIG. 2 is an isometric view of a metallic strip presenting a series of triangular folds having circular perforations.

As can be appreciated in the accompanying drawings and, particularly, in FIGS. 1 and 2 representing a preferred embodiment of the invention, the structural element comprises two structural elements (10) and (20).

A first element, is shaped as a "C"-type profile (10) having parallel and equidistant edges (4).

The second element of the structural member of the present invention is a metallic strip (20), having triangular folds(8) that fit in dimension and separation with the rectangular cavities (6) of the "C"-type structural element (10).

The triangular folds (8) of the metallic strip (20) have a circular perforation (12) on each of its two sides (8).

Figure 3:
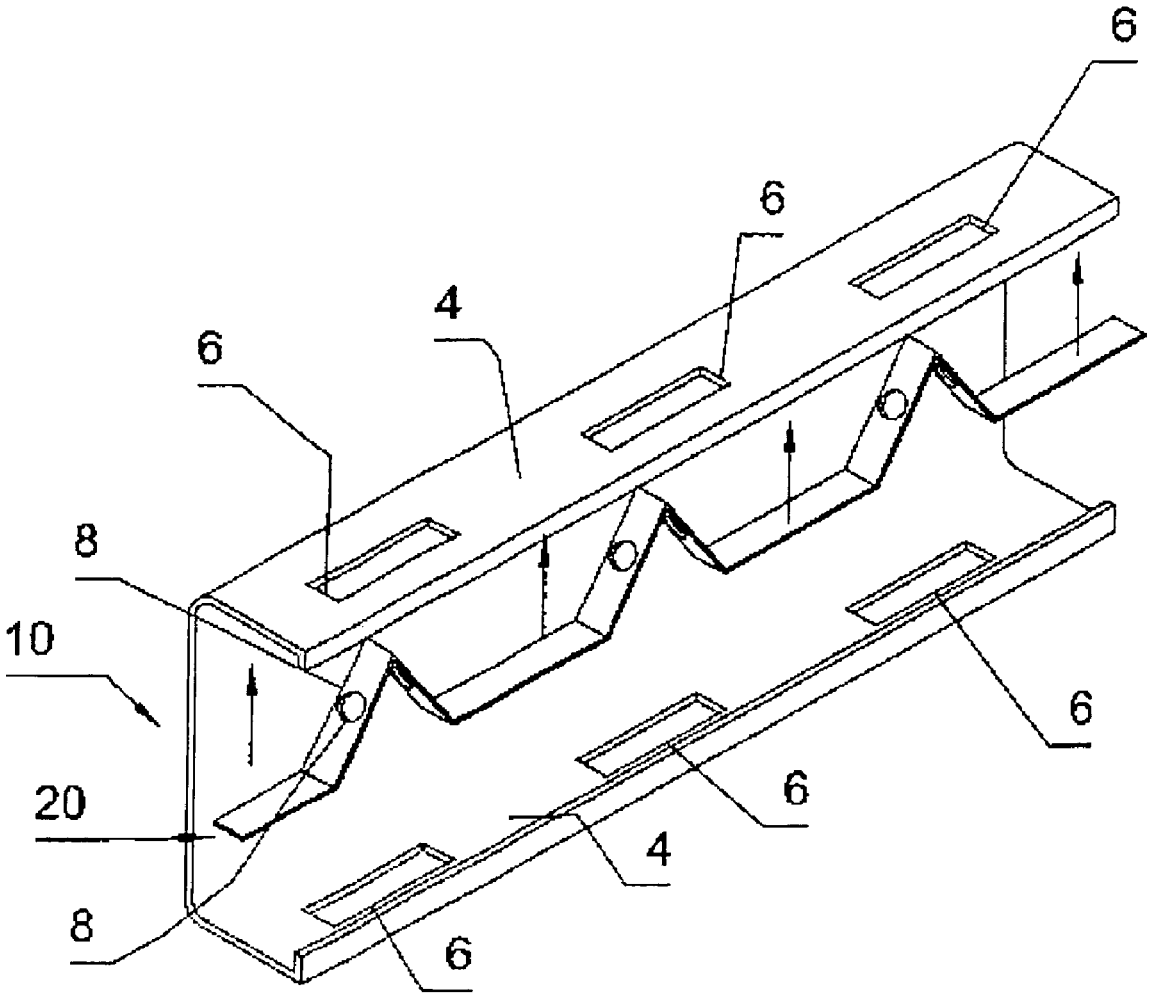
FIG. 3 is an isometric view of the "C" profile and the metallic strip prior to being assembled.
Figure 4:
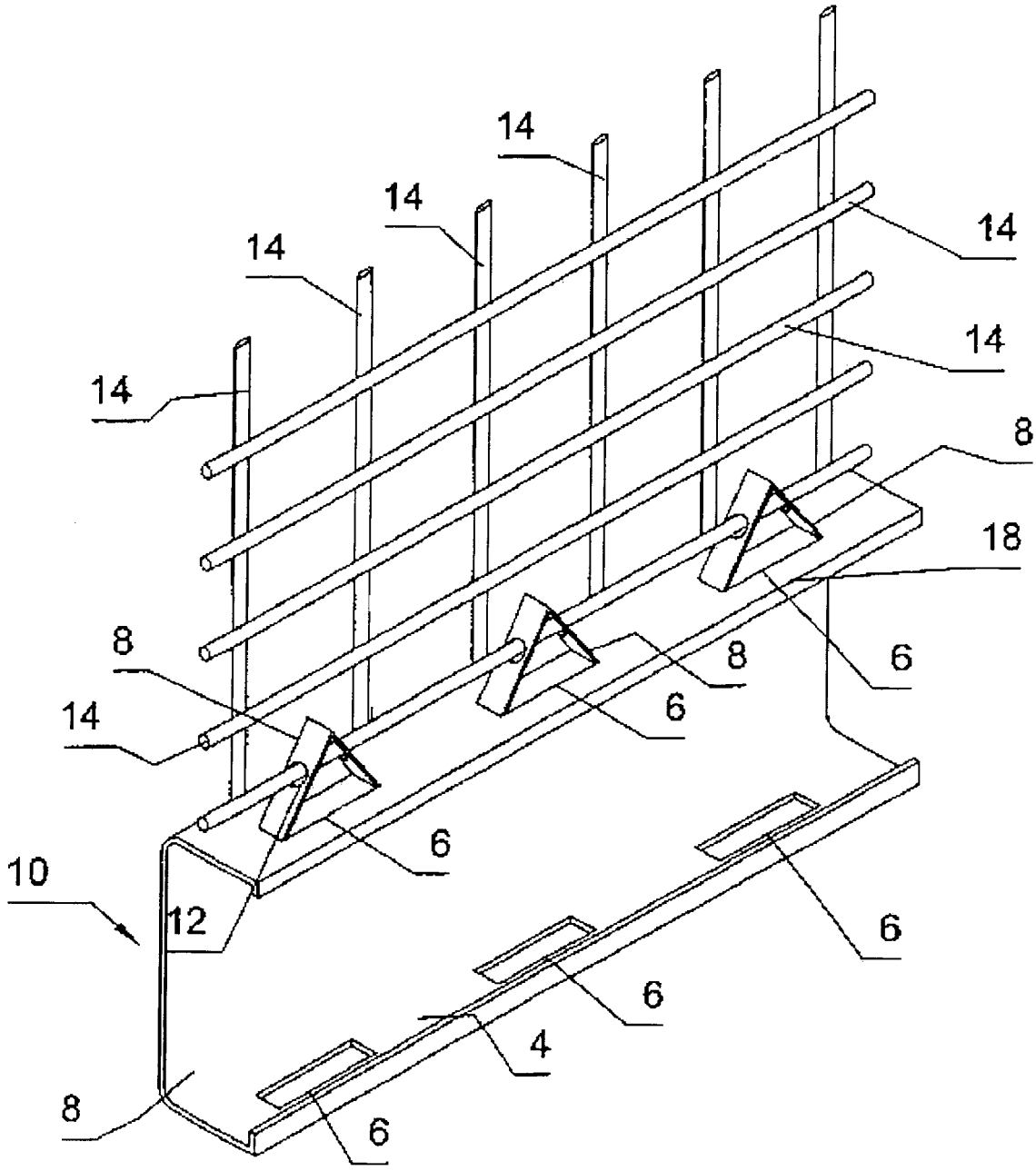
FIG. 4 is an isometric view of the "C" profile and the metallic strip assembled together with the frame of a panel that can be a wall, soffit or slab of the construction.

As can be appreciated from FIG. 3, both elements of the invention (10) and (20) are assembled to each other by passing the triangular folds (8) of the metallic strip (20) through the rectangular cavities (6) of the "C"-type metal element (10), of which fit in dimension and separation with the triangular folds (8) of the metallic strip (20).

Once the two elements (10) and (20) are assembled, the frames (14) of any panel to be constructed in the building are inserted through the circular perforations (12) of the triangular folds (8) of the metallic strip (20).

Once the structural system is completely assembled, the panel (16) is then strained with any cement material (preferably concrete). The panel (16) can indistinctly function as a wall, as a soffit or as a slab, since the "C"-type metal element (10) is able to serve as a pole and cross-beam, or as a column and beam, depending on the thickness and the resistance of the material itself from which it is manufactured to form walls, slabs or soffits in a building.

The present invention assures a constructive seam (18) between the metallic elements (10) of the construction, that could be poles, cross-beams, columns or beams, with the several panels (16) used in the same construction; since the frames (14) of the panels are reliably fastened to the structural members (10, 12) of the construction, through the circular perforations (12) formed on the edges (8) of the triangular folds of the metallic strip (20) that are attached to the "C"-type profile (10).

Once the reference panel (16) is strained, it can be assured that the same cannot be separated from the metallic structure (10) by the various physical forces acting on the construction structure, unless the separation is carried out by mechanical means.

From the above description, it can be concluded that the main object of the invention is fulfilled, that is, to provide a structural element of which integration to the constructive system is highly reliable, said structural element acting as a pole or as a beam.

I claim:

1. A structural member for connection to a cast panel having internal reinforcement, said structural member comprising:

a first element having a generally C-shaped cross section including first and second generally parallel faces spaced from each other by a third intermediate face;

a plurality of apertures spaced equidistantly on at least one of said faces;

a second element comprising a continuous strip with a plurality of angular folds spaced along said strip to form folded portions spaced equidistantly from each other;

said second element being positioned within said first element with substantially the entirety of said strip between said folded portions positioned within said first element and substantially the entirety of said strip at said folded portions projecting outwardly through respective apertures of the C-shaped first element and then returning to within said first element through each of said apertures;

said folded portions of said second element being adapted to be connected to the internal reinforcement of a cast panel.

2. The structural member for connection to a cast panel according to claim 1, wherein said plurality of apertures are formed in said first face or said second face of said first element.

3. The structural member for connection to a cast panel according to claim 1, wherein the folded portions of said second element are generally triangular in shape.

4. The structural member for connection to a cast panel according to claim 1, wherein the folded portions of said second element comprise perforations for receiving a portion of the internal reinforcement of a cast panel to thereby connect said structural member to the cast panel.

5. The structural member for connection to a cast panel according to claim 3, wherein adjoining portions of the said triangular folded portions of said second element comprise perforations for receiving a portion of the internal reinforcement of a cast panel to thereby connect said structural member to the cast panel.

6. The structural member according to claim 1, connected by said folded portions to a cast panel thereby forming an element for the construction of a building.

7. The structural member connected to a cast panel according to claim 6, in the form of a slab or wall which can function as a beam or column of the construction.

8. The structural member for connection to a cast panel according to claim 1, wherein at least said second element is formed of metal.

9. The structural member for connection to a cast panel according to claim 1, wherein said first and second elements are formed of metal.

10. A structural member for connection to a cast panel having internal reinforcement, said structural member comprising:

a first element having a plurality of faces;

a plurality of apertures spaced equidistantly on at least one of said faces;

a second element comprising a continuous strip with a plurality of angular folds spaced along said strip to form folded portions spaced equidistantly from each other;

said second element being positioned within said first element with substantially the entirety afraid strip between said folded portions positioned within said first element and substantially the entirety of said strip at said folded portions projecting outwardly through respective apertures of the first element and then returning to within said first element through each of said apertures;

said folded portions of said second element being adapted to be connected to the internal reinforcement of a cast panel.

11. The structural member according to claim 10, connected by said folded portions to a cast panel thereby forming an element for the construction of a building.

12. A structural member for connection to a cast panel having internal reinforcement, said structural member comprising:

a first element having a generally C-shaped cross section including first and second generally parallel faces spaced from each other by a third intermediate face;

a plurality of apertures spaced equidistantly on at least one of said faces;

a second element comprising a continuous strip with a plurality of angular folds spaced along said strip to form folded portions spaced equidistantly from each other;

said second element being positioned within said first element with substantially the entirety of said strip between said folded portions positioned within said first element and substantially the entirety of said strip at said folded portions projecting outwardly through respective apertures of the C-shaped first element.

* * * * *